US007455265B2

(12) United States Patent
Jones

(10) Patent No.: US 7,455,265 B2
(45) Date of Patent: Nov. 25, 2008

(54) SYSTEMS AND DEVICES FOR STORING, RELEASING AND RETRIEVING RAILWAY SURVEILLANCE VEHICLES

(76) Inventor: Thomas L. Jones, 11 Yorkshire St., Asheville, NC (US) 28803

( * ) Notice: Subject to any disclaimer, the term of this patent is extended or adjusted under 35 U.S.C. 154(b) by 288 days.

(21) Appl. No.: 11/398,542

(22) Filed: Apr. 6, 2006

(65) Prior Publication Data

US 2006/0225602 A1 Oct. 12, 2006

Related U.S. Application Data

(60) Provisional application No. 60/668,604, filed on Apr. 6, 2005.

(51) Int. Cl.

| | |
|---|---|
| ***B61L 1/00*** | (2006.01) |
| ***B60Q 1/00*** | (2006.01) |
| ***A01D 90/00*** | (2006.01) |
| ***B65F 9/00*** | (2006.01) |

(52) U.S. Cl. ..... 246/166; 340/425.5; 414/583; 414/338; 414/339

(58) Field of Classification Search ..... 105/72, 105/396, 18, 1.4; 414/583, 678, 339, 354; 340/425.5; 246/166; 104/272

See application file for complete search history.

(56) References Cited

U.S. PATENT DOCUMENTS

| | | | | |
|---|---|---|---|---|
| 1,807,268 | A * | 5/1931 | Woodruff | 410/54 |
| 2,478,658 | A * | 8/1949 | Harbers | 414/339 |
| 3,128,975 | A * | 4/1964 | Dan | 246/121 |
| 3,233,559 | A * | 2/1966 | Smith et al. | 104/292 |
| 3,327,879 | A * | 6/1967 | Lull | 414/704 |
| 3,561,621 | A * | 2/1971 | Rivers, Jr. | 414/537 |
| 4,578,665 | A * | 3/1986 | Yang | 246/166.1 |
| 4,826,474 | A * | 5/1989 | Holmes | 414/699 |
| 5,238,357 | A * | 8/1993 | Patrick et al. | 414/420 |
| 5,429,329 | A * | 7/1995 | Wallace et al. | 246/166 |
| 5,624,049 | A * | 4/1997 | Kovash et al. | 220/1.5 |
| 5,627,508 | A * | 5/1997 | Cooper et al. | 340/425.5 |
| 6,273,004 | B1 * | 8/2001 | Klag | 105/404 |
| 6,831,573 | B2 * | 12/2004 | Jones | 340/903 |
| 2005/0244255 | A1 * | 11/2005 | Smith et al. | 414/339 |
| 2006/0225602 | A1 * | 10/2006 | Jones | 105/72 |

* cited by examiner

*Primary Examiner*—S. Joseph Morano
*Assistant Examiner*—Jason C Smith
(74) *Attorney, Agent, or Firm*—Connolly Bove Lodge & Hutz LLP

(57) ABSTRACT

Systems and devices for storing railway surveillance vehicles on trains and placing railway surveillance vehicles onto railway tracks.

11 Claims, 8 Drawing Sheets

SYSTEMS AND DEVICES FOR STORING, RELEASING AND RETRIEVING RAILWAY SURVEILLANCE VEHICLES

This application claims the benefit of U.S. provisional application No. 60/668,604, filed on Apr. 6, 2005, and entitled "Lift Apparatus For A Railway Surveillance Vehicle," the disclosure of which is incorporated herein by reference.

BACKGROUND

In U.S. Pat. No. 6,831,573 discloses surveillance vehicles that proceed along a railway ahead of a train and monitors the railway to prevent the train from encountering hazards on the railway and derailing. In order to promote efficient use of such surveillance vehicles, there remains a need for systems and devices for storing, releasing and retrieving the surveillance vehicles.

SUMMARY

The disclosure relates to systems and devices for storing railway surveillance vehicles on trains, releasing the railway surveillance vehicles on railway tracks and retrieving the railway surveillance vehicles from railway tracks.

According to certain embodiments, a lift apparatus for a railway surveillance vehicle is disclosed, said lift apparatus being connected to an end of a train or train engine and arranged to secure and release said surveillance vehicle, wherein said lift apparatus is movable between a first position in which said surveillance vehicle can be stored on said end of the train or engine and a second position in which said surveillance vehicle can be released onto railway track or retrieved from said railway track.

According to other embodiments, a train system comprises:

a train or train engine;

at least one surveillance vehicle; and at least one lift apparatus connected to an end of said train or train engine and arranged to secure and release said at least one surveillance vehicle, wherein said at least one lift apparatus is movable between a first position in which said at least one surveillance vehicle can be stored on said end of the train or train engine and a second position in which said at least one surveillance vehicle can be released onto a railway track or retrieved from said railway track.

According to another embodiment, a train system comprises:

a train or train engine comprising at least one train coupling attached to an end thereof; and at least one surveillance vehicle comprising at least one surveillance vehicle coupling attached to an end thereof, wherein said at least one train coupling and said at least one surveillance vehicle coupling are arranged to engage each other for storing said at least one surveillance vehicle on said train or train engine, and wherein said at least one train coupling and said at least one surveillance vehicle coupling are arranged to disengage each other for releasing said at least one surveillance vehicle on a railway track.

Additional features and advantages will be apparent from the following detailed description and drawings.

DETAILED DESCRIPTION

Figure 1:
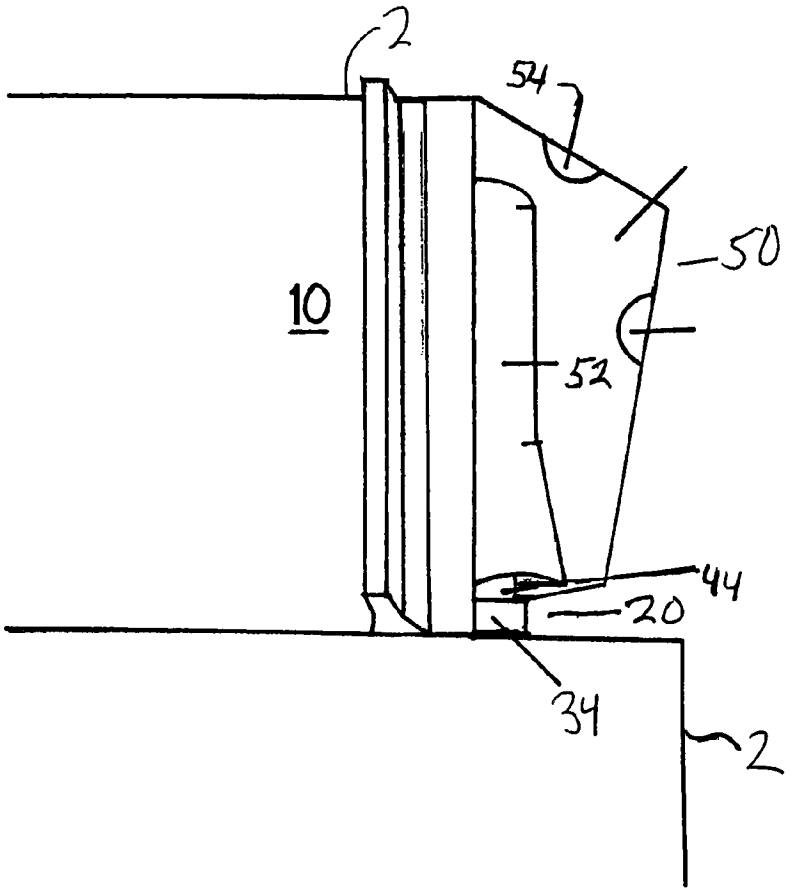
FIG. 1 shows one embodiment of a train system including a train engine, a railway surveillance vehicle and a lift apparatus for storing the surveillance vehicle on the train engine releasing the surveillance vehicle onto a railway track and retrieving the surveillance vehicle from the railway track, wherein the lift apparatus is holding the surveillance vehicle in a storage position on the train engine.

FIG. 1 illustrates an end 2 of a train engine 10 with an attached surveillance vehicle 50. A lift mechanism 20 is mounted on the end 2 of the engine 10, and is mechanized such that it is capable of lifting the surveillance vehicle 50 from a storage position on the engine 10 and placing it on the railroad track 60. The lift mechanism is further capable of retrieving the surveillance vehicle 50 from the railroad track 60 and returning the surveillance vehicle 50 to the rest position on the engine 10. The surveillance vehicle 50 may be similar to the surveillance vehicle disclosed in U.S. Pat. No. 6,831,573, issued Dec. 14, 2004, the entire disclosure of which is incorporated herein by reference.

Figure 2:
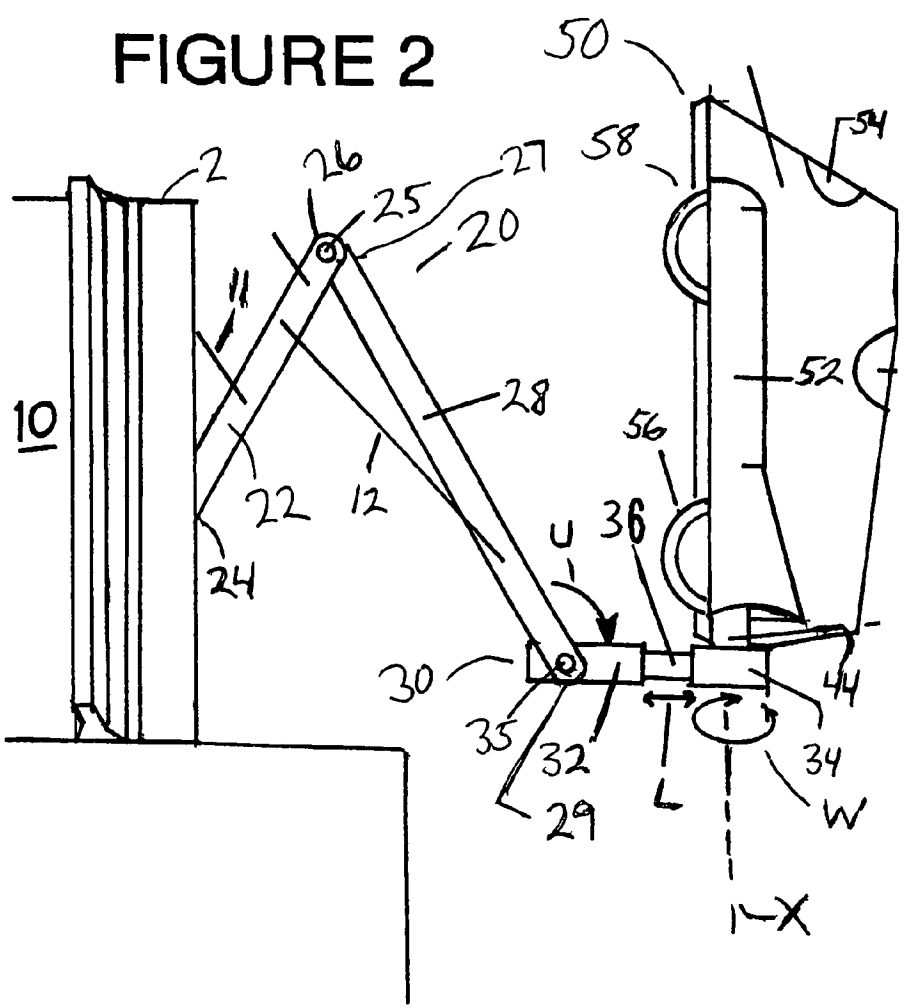
FIG. 2 is another view of the system of FIG. 1 showing the lift apparatus in the process of placing the surveillance vehicle on the railway track.
Figure 3:
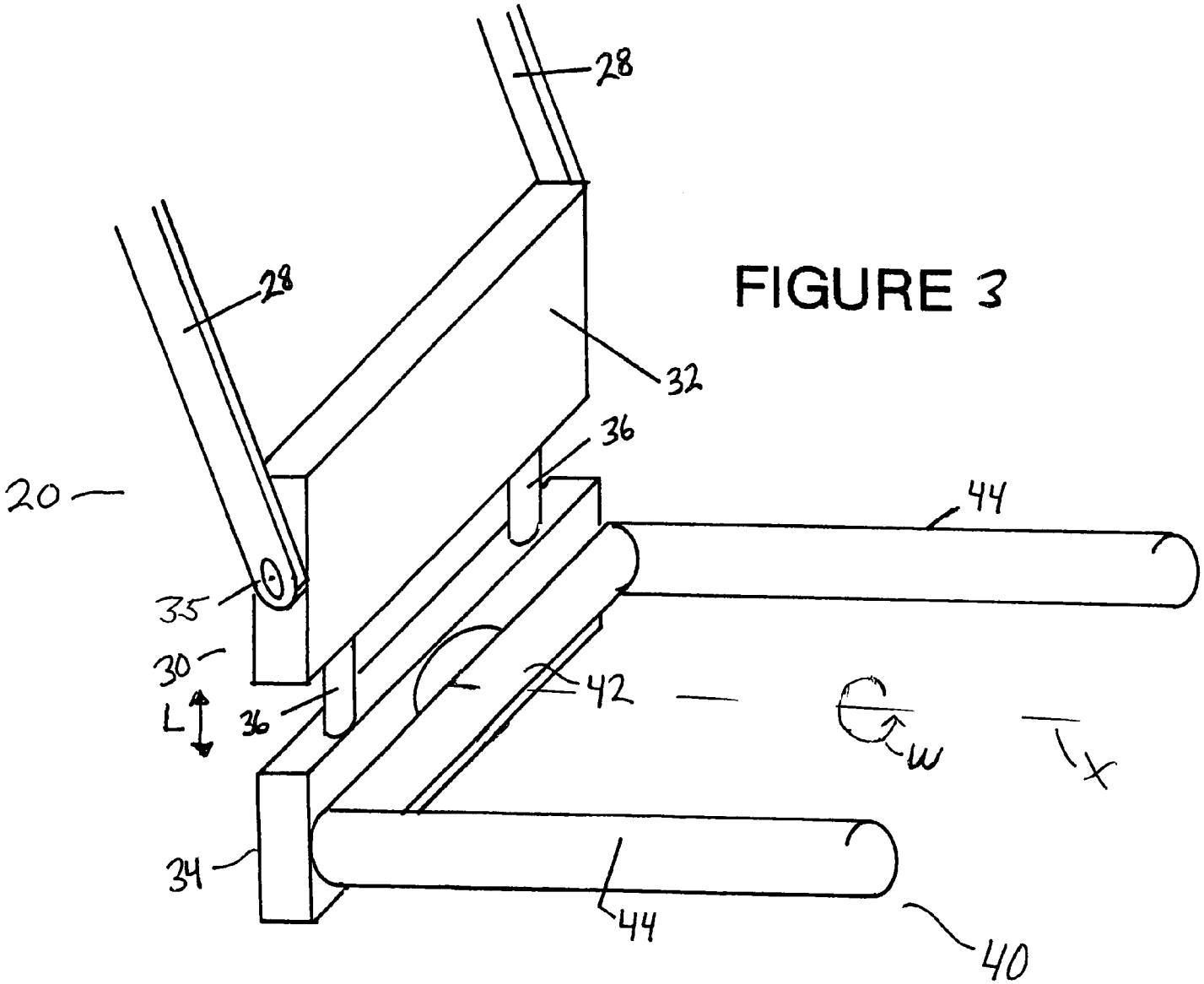
FIG. 3 is a perspective view of a lift arm support and a forked lift arm of the lift apparatus shown in FIGS. 1 and 2.

With reference to FIGS. 2 and 3, the lift mechanism 20 includes a first pair of parallel extension arms 22 having first ends 24 attached to an end 2 of the engine 10, a second pair of parallel extension arms 28 having a first end 27 pivotally connected at a joint 25 to second ends 26 of the first pair of extension arms 22, an adjustable lift arm support 30 pivotally attached to a second end 29 of the second extension arms 28 at a joint 35, and a forked lift arm 40 attached to the lift arm support 30. The lift arm support 30 includes a base portion 32 and an extension portion 34 connected to the base portion 32 by extension cylinders 36. Referring to FIG. 3, the lift arm 40 includes a pair of fork arms 44 extending from a base arm 42 that is rotatably attached to the extension portion 34 of the lift arm support 30. As indicated in FIGS. 2 and 3, the lift arm 40 is rotatable (W) about its longitudinal axis X.

Figure 4:
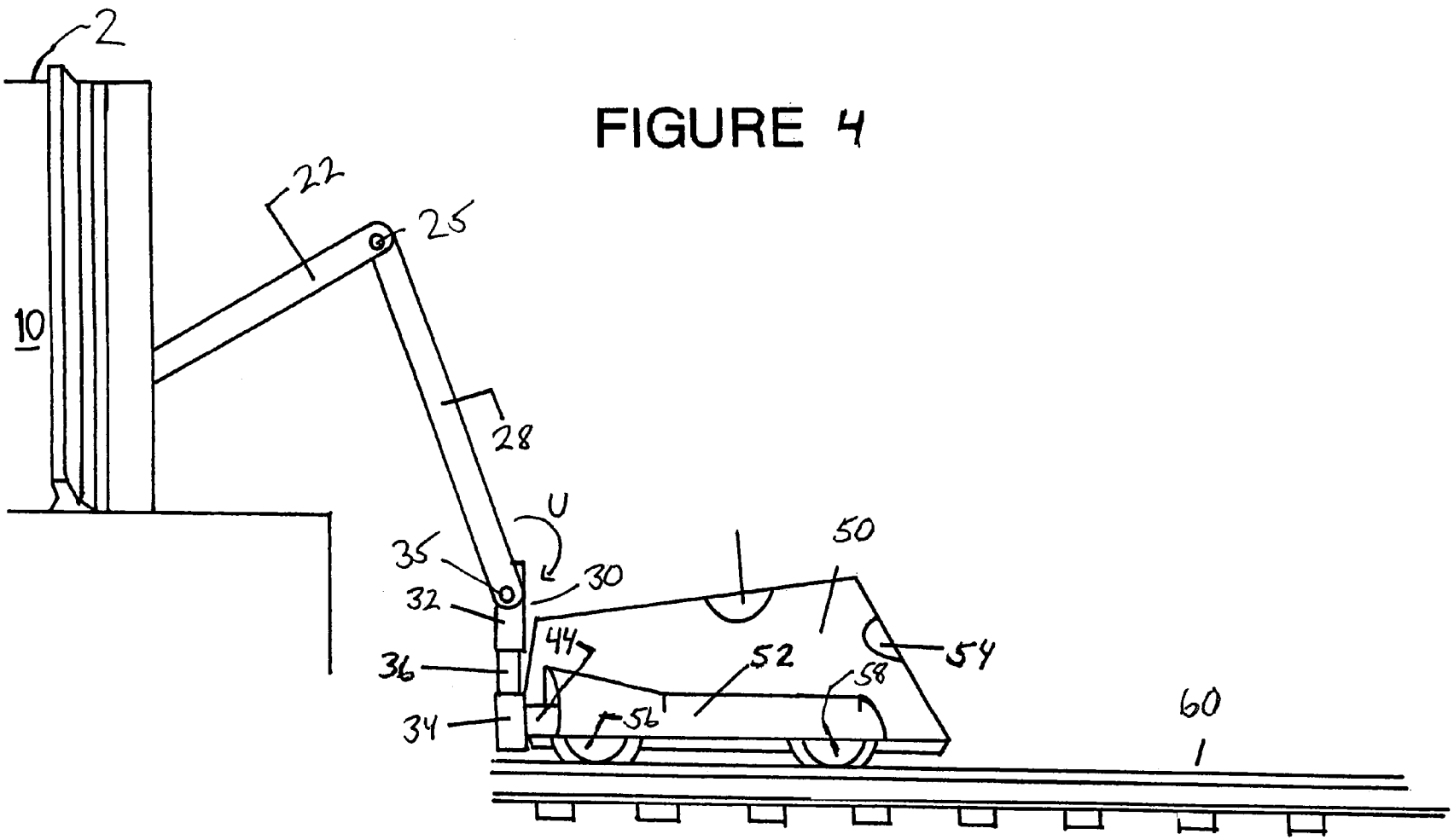
FIG. 4 shows the system of FIG. 1 as the surveillance vehicle is placed on the railway track by the lift apparatus.

As shown in FIGS. 1, 2 and 4, the fork arms 44 of lift arm 40 is insertable into lift-tubes 52 on opposing sides of the surveillance vehicle 50 to secure the surveillance vehicle 50 during the processes of lifting and the surveillance vehicle 50 from the track 60 and placing surveillance vehicle 50 on the tracks 60, and during storage of the surveillance vehicle 50 on the train engine 10. The surveillance vehicle 50 may include a light 54 which replaces the light on the front of the train engine 10 for night time operation.

The lift mechanism 20 may include actuators (not shown) may that operate to control the movement of the extension arms 22 and 28 and the lift arm support 30. Additionally, an actuator (not shown) may be provided in or attached to the mechanism 20 to rotate the base arm 42 of the lift arm 40. The actuators may be, for example, hydraulic, electric, magnetic or pneumatic devices.

FIG. 2 illustrates the lift mechanism 20 in the process of removing the surveillance vehicle 50 from its rest position on the train engine 10 and placing it onto the track 60. The arms 22 and 28 are acted on by a force (hydraulic, electric, magnetic, or pressurized air) from an actuator (not shown) which causes the arms 22 and 28 to extend away from the front of the train engine 10 and pivot about the joint 25, thereby extending the surveillance vehicle 50 away from the engine 10 and lowering the surveillance vehicle 50 toward the railroad track 60. The forces are applied along the planes 11 and 12. As this process occurs, the base arm 42 is rotated (W) by an actuator (not shown) to thereby rotate the lift arm 40 180 degrees about its longitudinal axis X, thereby rotating the surveillance vehicle 50 about its longitudinal axis (not shown) and bringing the wheels 56 and 58 of the surveillance vehicle 50 into position to be placed on the track 60. A force applied to the lift arm support 30 by another actuator (not shown) causes the lift arm support 30 to pivot downward in direction U about joint 35, thereby rotating the surveillance vehicle 50 downward and aligning the wheels 56 and 58 with the railway track 60. The lift arm support 30 utilizes the extension member 34 and a force applied thereto by an actuator (not shown) to make more subtle linear adjustments L to the height of the surveillance vehicle 50 as the wheels 56 and 58 of the surveillance vehicle contact the railroad track 60 and the vehicle 50 is released.

Figure 5:
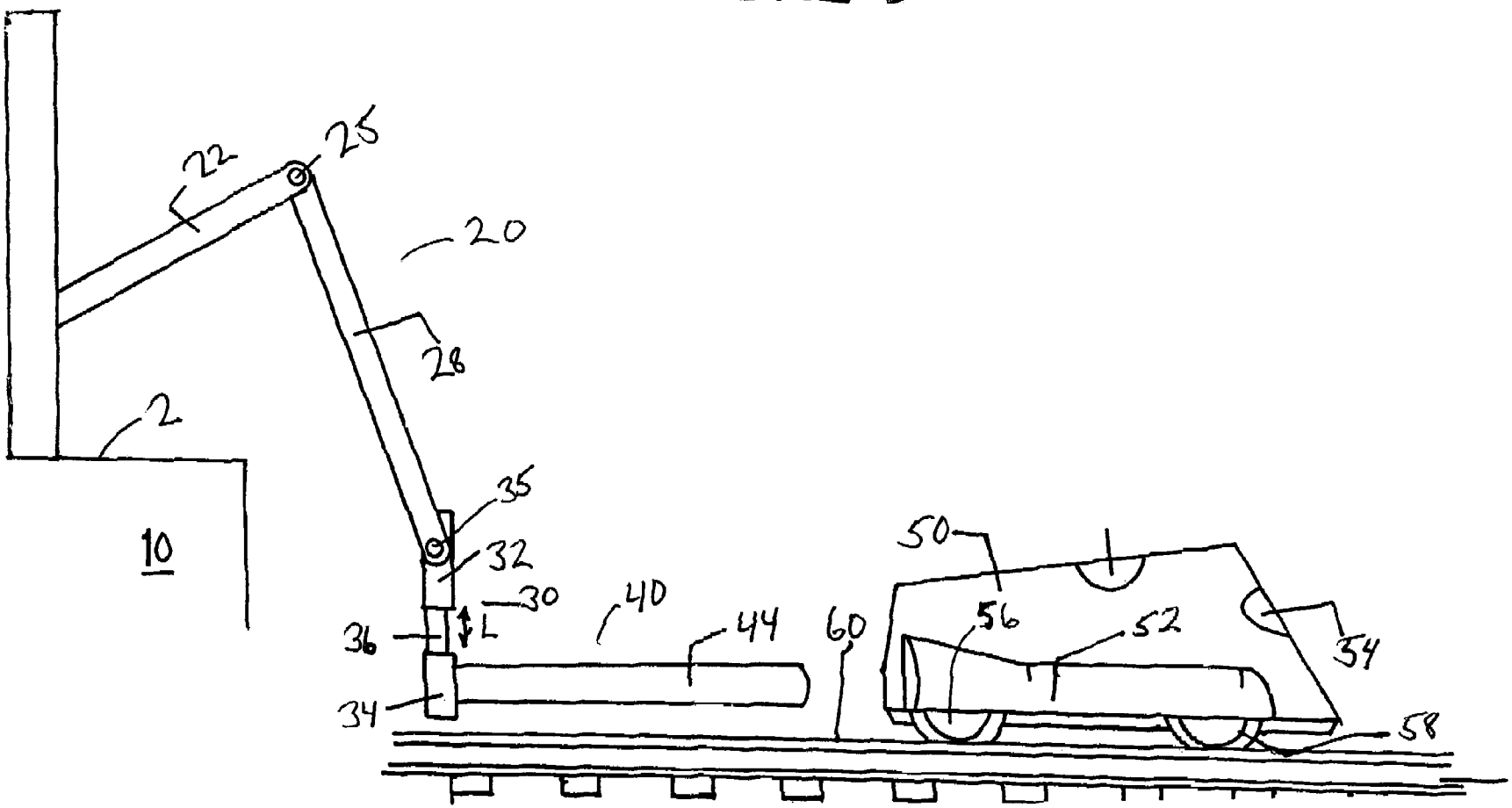
FIG. 5 shows the system of FIG. 1 as the surveillance vehicle has been released from the lift apparatus onto the railway track.

Release of the surveillance vehicle 50 onto the track 60 is illustrated in FIGS. 4 and 5. Viewing FIGS. 4 and 5, one can see the relationship of the extension arms 22 and 28 to the end of the train engine 2, the position of the lift arm support 30 at the end 29 of the second extension arm 28, the position of the extension cylinders 36 and the extension portion 34 of the lift arm support 30 at the time the surveillance vehicle 50 is placed on the track 60. After the lift mechanism 20 is fully extended into position to release the vehicle 50 onto the track 60, the fork arms 44 disengage the lift tubes 52 and the surveillance vehicle 50 is free to proceed on the track 60 in the direction in which the train is heading. Release of the surveillance vehicle 50 may be accomplished by retracting the lift arm 40 away from the surveillance vehicle until the fork arms 44 clear the lift tubes 52 or by advancing the surveillance vehicle along the track 60 away from the train engine 10.

To place the surveillance vehicle 50 in a storage position on the end 2 of the train engine 10, the above process is reversed. More specifically, as the surveillance vehicle 50 comes is resting or traveling on the railroad track 60, the lift mechanism 20 is extended such that the forked lift arm 40 is lowered to align the fork arms 44 with the lift tubes 52. The surveillance vehicle 50 is then moved in its reverse direction from a control unit (not shown) in the train engine 10 until the fork arms 44 are received in the lift tubes 52. The forked lift arm 40 is thereafter angled upward by rotating the lift arm support 30 in the direction opposite the direction U, thereby raising the front wheels 58 of the surveillance vehicle 50 prior to raising the rear wheels 56. Thereafter, the extension arms 22 and 28 are retracted, and the lift arm support 30 is further rotated in the direction opposite the direction U. Once the surveillance vehicle has sufficiently cleared the tracks 60, the lift arm 40 may be rotated in the direction W or opposite the direction W until the wheels 56 and 58 of the surveillance vehicle 50 face the end 2 of the train engine 10. Thereafter, the extension arms 22 and 28 may be further retracted, and the lift arm support 30 may be further rotated, as necessary, in order to place the surveillance vehicle 50 in its rest position on the end 2 of the train engine 10.

If the train engine 10 is proceeding along the railroad tracks and is retrieving the surveillance vehicle on the "fly", the surveillance vehicle 50 may be slowed to allow the fork arms 44 to engage the lift tubes 52. Thereafter the lift mechanism 20 may lift the surveillance vehicle 50 from the railroad track 60, and thereafter place the surveillance vehicle 50 in its rest position on the end 2 of the train engine 10, as described above.

Two surveillance vehicles 50 with the accompanying lift mechanisms 20 may be provided on each train engine 10 such that one surveillance vehicle 50 is positioned on each end of the train engine 10. This arrangement will accommodate the use of multiple train engines 10 and multiple train cars, as often is the case, and circumstances in which it would not be practical to turn the train engine 10 around. It is contemplated that all of the surveillance vehicles 50 would be retrieved from the railroad track 60 and placed in their rest positions on the ends of the train engine 10, as shown in FIG. 1, before entering a train yard.

Figure 6:
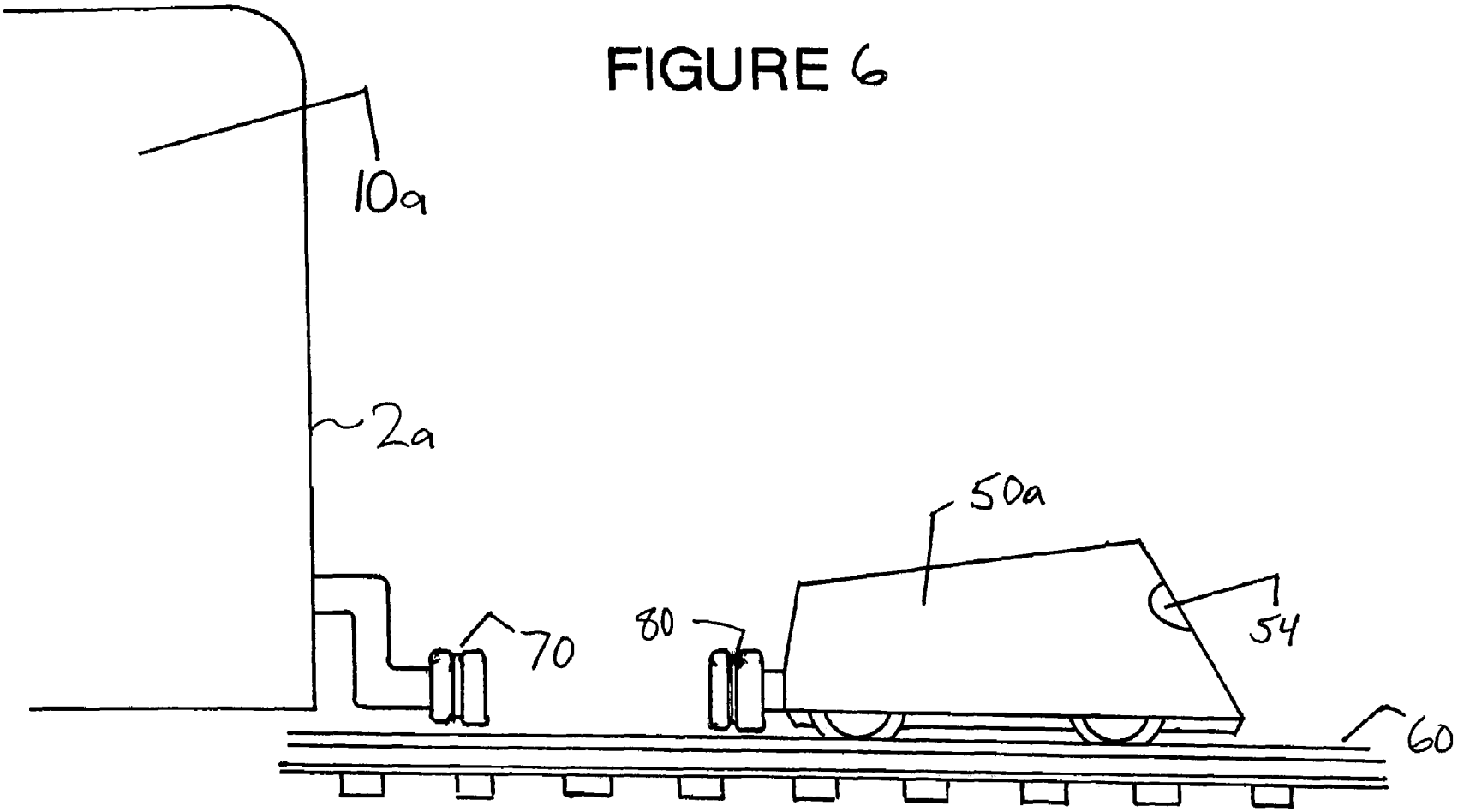
FIG. 6 shows another embodiment of a train system, wherein a train and a surveillance vehicle include conventional train couplings for storing the surveillance vehicle on the train and releasing the surveillance vehicle on a railway track.

FIG. 6 illustrates how the surveillance vehicle 50*a* may be attached to an end 2*a* of a commuter train 10*a* utilizing conventional train couplings. As shown in FIG. 6, the train 10*a* includes a conventional train coupling 70. The surveillance vehicle 50*a* includes a conventional coupling 80 designed to engage the train coupling 70. In a configuration employing two surveillance vehicles, a first surveillance vehicle 50*a* may be attached to the end 2*a* of the train 10*a* and a second surveillance vehicle may be attached to an opposite end (not shown) of the train 10*a* via another coupling 80. Thus, one of the surveillance vehicles 50*a* can be released on the track 60 in the direction in which the train 10*a* is traveling, while the other surveillance vehicle 50*a* is pulled behind the train 10*a*. This configuration would be compatible with a "push-pull" operation as is commonly used in commuter train operations.

Figure 7:
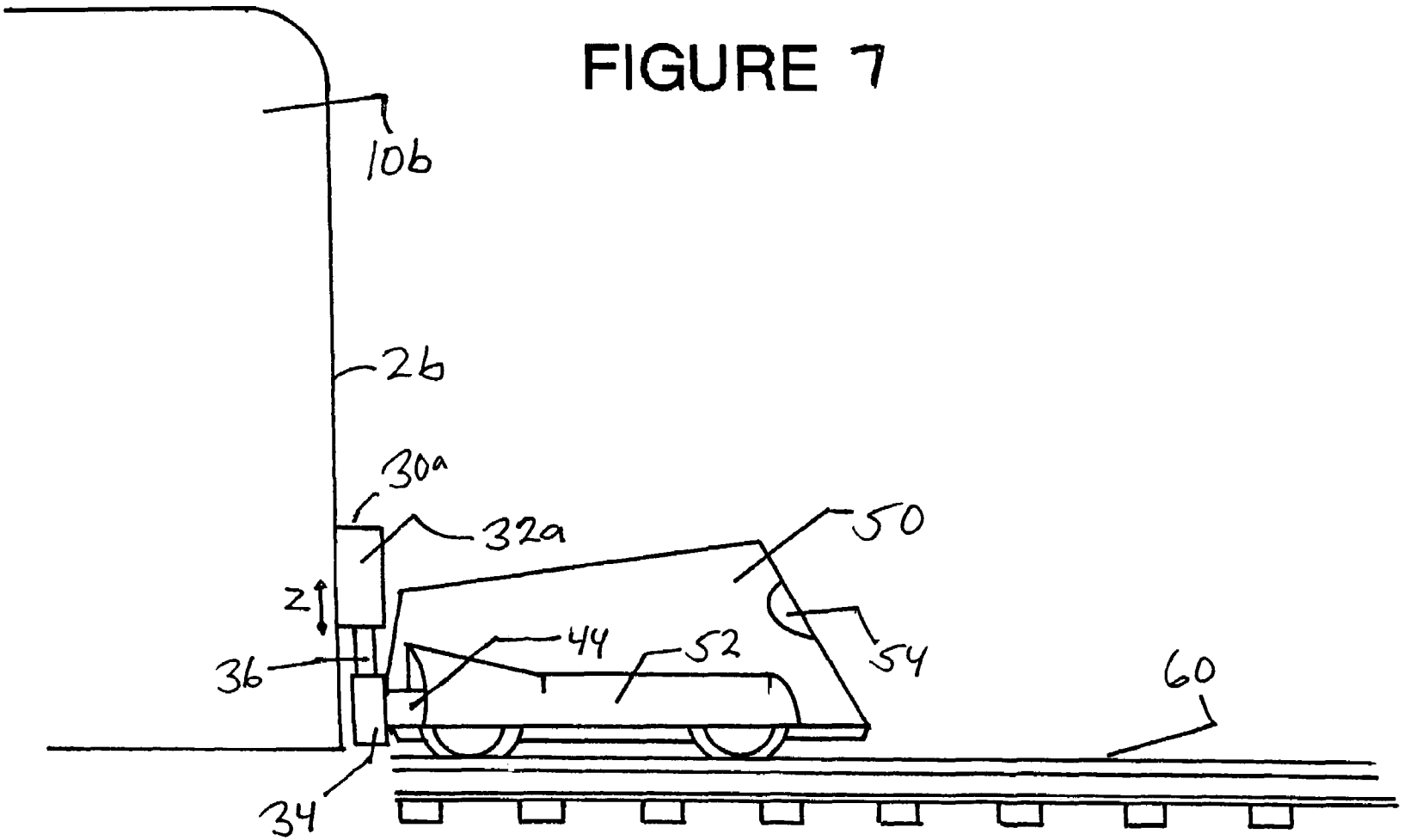
FIG. 7 shows another embodiment of a train system including a lift apparatus for a railway surveillance vehicle, wherein the lift apparatus is engaged with the surveillance vehicle as the surveillance vehicle rests on the railway track.

FIG. 7 illustrates another device and method of attaching a surveillance vehicle 50 to a commuter train 10*b*. In this instance, the surveillance vehicle 50 is attached to the train 10*a* using a lift mechanism 90 including an adjustable lift arm support 30*a* and a forked lift arm 40*a* attached to the lift arm support 30*a*. The lift arm support 30*a* is similar in design and function to the lift arm support 30 shown in the embodiment of FIGS. 1-5, except that the lift arm support 30*a* includes a base portion 32*a* attached to the end 2*b* of the train 10*b*. The base portion 32 is connected to an extension portion 34 by extension cylinders 36. The lift arm support extends vertically downward along the end 2*a* of the train.

Figure 8:
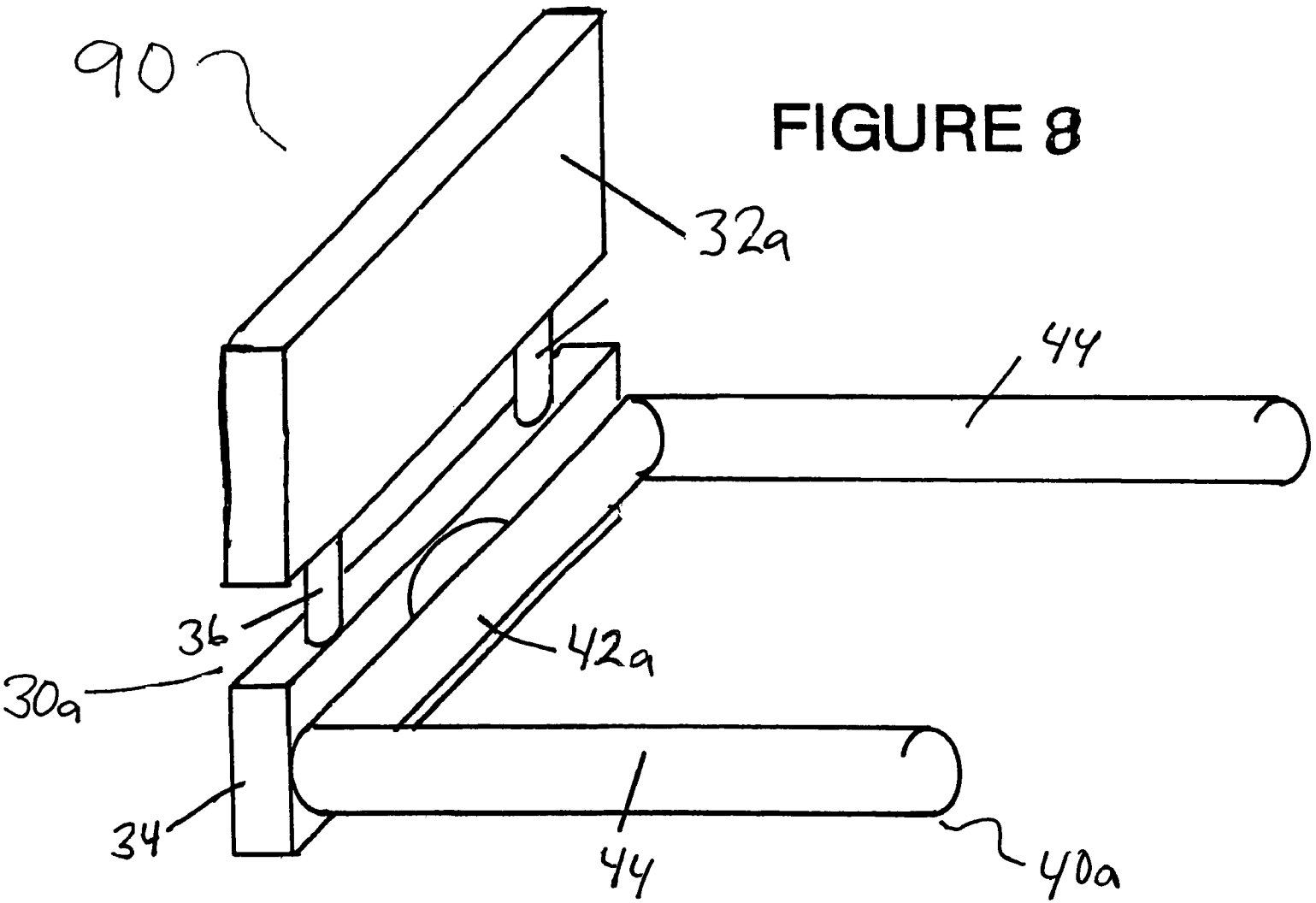
FIG. 8 is a perspective view of a lift arm support and a forked lift arm of the lift apparatus shown in FIG. 7.

As shown in FIG. 8, the lift arm 40*a* includes a pair of fork arms 44 extending from a base arm 42*a* that is attached to the extension portion 34 of the lift arm support 30. The extension cylinders 36 are able to extend and retract vertically (Z) in order to move the forked lift arm 40 up and down. The fork arms 44 can be inserted into the lift tubes 52 as described in the embodiment of FIGS. 1-5.

In order to place the vehicle 50 in its storage position, the lift arm 40*a* is lowered into alignment with the lift tubes 52 of the vehicle 50. The fork arms 44 are thereafter brought into engagement with the lift tubes 52 by advancing the train 10*b* with respect to the vehicle 50 and/or by reversing the vehicle 50. The forked lift arm 40*a* is then lifted by the extension cylinders 36, and the surveillance vehicle 50 is thereby lifted from the track 60 and carried on the end 2*b* of the commuter train 10*b*.

In order to release the surveillance vehicle 50 onto the track 60, the forked lift arm 40*a* is lowered by the extension cylinders 36 until the surveillance vehicle 50 is placed on the tracks. The surveillance vehicle 50 may then be advanced away from the train 10*b* in order to disengage the fork arms 44 from the lift tubes 52.

Figure 9:
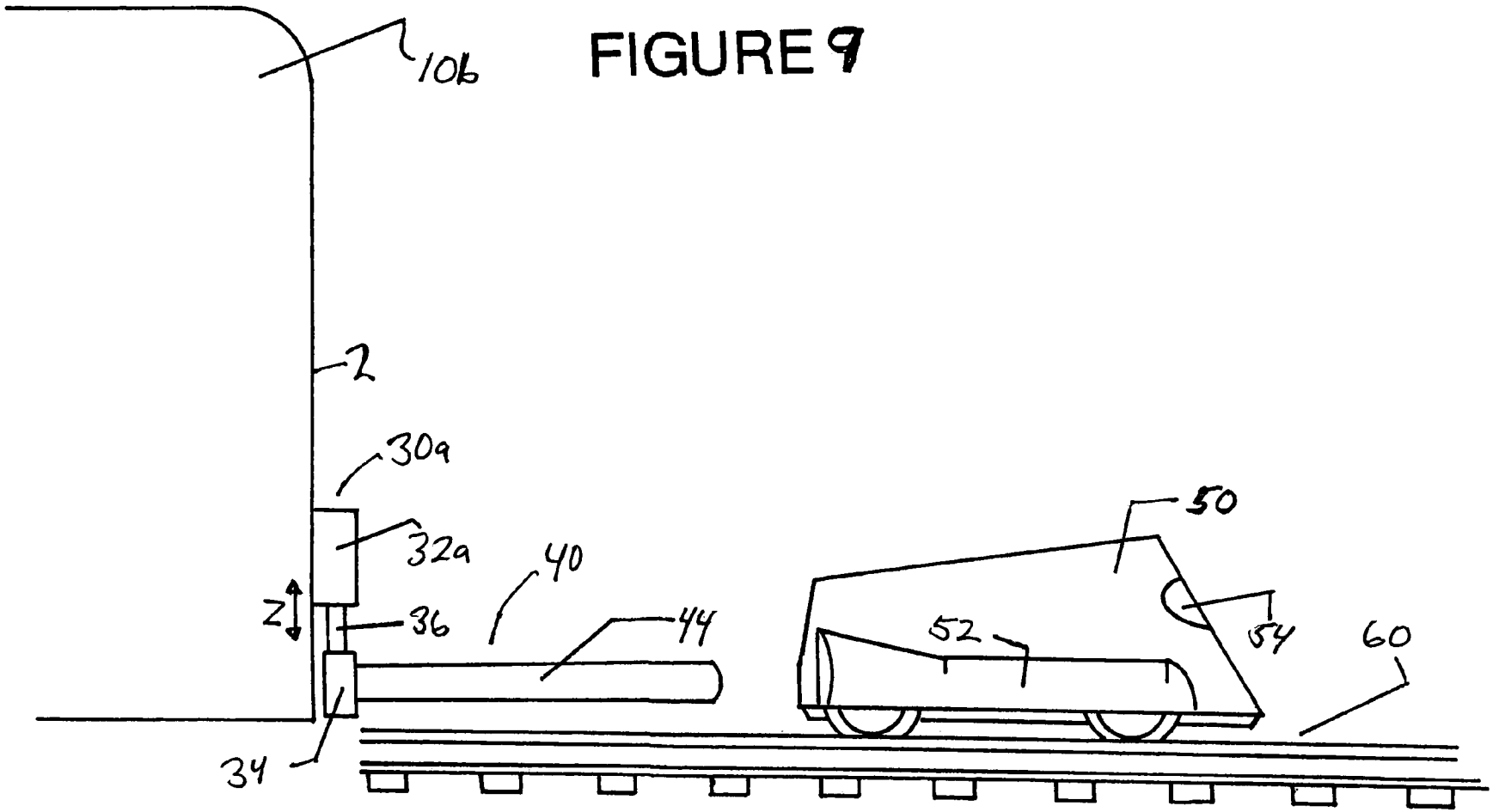
FIG. 9 shows the system of FIG. 7, wherein the surveillance vehicle has been released from the lift apparatus onto the railway track.

FIG. 9 illustrates the train 10*b* and surveillance vehicle 50 after the surveillance vehicle 50 has been released from the train 10*b* and is proceeding down the track 60. A commuter train 10*b* could have a lift mechanism 90 on each end of the commuter train, and each lift mechanism 90 would be capable of retrieving the surveillance vehicle 50, lifting the surveillance vehicle 50 from the railroad track 60 and placing the surveillance vehicle 50 on the railroad track 60 to release the surveillance vehicle 50. It is contemplated that the when the lift mechanism 90 is utilized by commuter trains 10*b* using a "push-pull" type of operation, the lift mechanism on one end of the commuter train 10*b* would be attached to the end of a train car (not shown). The arrangement of FIGS. 7-9 is also compatible with a "push-pull" method of operation, in which a second train 10*b* can be stored at an opposite end (not shown) of the train using a second lift apparatus 30*a* attached thereto.

It should be understood that the described devices and methods may be embodied in other specific forms or variations without departing from their spirit or essential characteristics. Accordingly, the embodiments described above are to be considered in all respects as illustrative and not restrictive, the scope of the disclosure being indicated by the appended claims rather than the foregoing description, and all changes which come within the meaning and range of equivalency of the claims are intended to be embraced therein.

The invention claimed is:

1. A lift apparatus for a railway surveillance vehicle, said lift apparatus being connected to an end of a train engine and arranged to secure and release said surveillance vehicle, wherein said lift apparatus is movable between a first position in which said surveillance vehicle can be stored on said end of the train engine and a second position in which said surveillance vehicle can be released onto a railway track or retrieved from said railway track;

wherein said lift apparatus comprises at least one extension arm, wherein said at least one extension arm is pivotable to extend and retract said lift apparatus, and a lift arm connected to said at least one extension arm, wherein said lift arm is arranged to engage said surveillance vehicle;

wherein said lift apparatus comprises a lift arm support connecting said at least one extension member to said lift arm, wherein said lift arm support is extendable and retractable to vary a position of said lift arm;

wherein said lift arm comprises a rotatable base arm connecting said lift arm to said lift arm support, said rotatable base being arranged to rotate said lift arm about a central axis of the lift arm; and wherein said lift arm comprises a pair of fork arms extending from said rotatable base arm, said fork arms being arranged to engage lift tubes on opposing sides of said surveillance vehicle.

2. The lift apparatus of claim 1, wherein said lift arm is arranged to rotate said surveillance vehicle about a longitudinal axis of said surveillance vehicle between an orientation for storage on said train engine and an orientation for placement on said railway track.

3. The lift apparatus of claim 1, wherein said at least one extension arm comprises:

a first pair of extension arms having a first end attached to said end of said train engine; and a second pair of extension arms having a first end pivotably attached to a second end of said first pair of said extension arms and having a second end pivotably connected to said lift arm support.

4. The lift apparatus of claim 1, wherein said lift arm support comprises:

a base member; and an extension member connected to said base member by a pair of extension cylinders that are linearly extendable and retractable to vary a position of said extension member, wherein said lift arm is attached to said extension member.

5. The lift apparatus of claim 1, wherein said lift arm comprises a rotatable base arranged to rotate said lift arm about a central axis of the lift arm.

6. The lift apparatus of claim 5, wherein said lift arm comprises a pair of fork arms extending from said rotatable base, said fork arms being arranged to engage lift tubes on opposing sides of said surveillance vehicle.

7. The lift apparatus of claim 1, comprising:

a lift arm support attached to said end of said train or train engine; and a lift arm attached to said lift arm support, wherein said lift arm is arranged to engage said surveillance vehicle.

8. The lift apparatus of claim 7, wherein said lift arm support is a vertically extendable and retractable to vary a position of said lift arm.

9. The lift apparatus of claim 8, wherein said lift arm support comprises:

a base member; and an extension member connected to said base member by a pair of extension cylinders that are linearly extendable and retractable to vary a position of said extension member, wherein said lift arm is attached to said extension member.

10. The lift apparatus of claim 9, wherein said lift arm comprises:

a base arm attached to said extension member; and a pair of fork arms attached to said base arm, wherein said fork arms are arranged to engage lift tubes on opposing sides of said surveillance vehicle.

11. The lift apparatus of claim 10, wherein said lift arm comprises:

a base arm attached to said lift arm support; and a pair of fork arms attached to said base arm, wherein said fork arms are arranged to engage lift tubes on opposing sides of said surveillance vehicle.

* * * * *